US010351293B2

(12) United States Patent
Bader

(10) Patent No.: US 10,351,293 B2
(45) Date of Patent: Jul. 16, 2019

(54) CONTAINER

(71) Applicant: Scott Douglas Bader, Los Angeles, CA (US)

(72) Inventor: Scott Douglas Bader, Los Angeles, CA (US)

( * ) Notice: Subject to any disclaimer, the term of this patent is extended or adjusted under 35 U.S.C. 154(b) by 0 days.

(21) Appl. No.: 15/840,362

(22) Filed: Dec. 13, 2017

(65) Prior Publication Data

US 2018/0170611 A1 Jun. 21, 2018

Related U.S. Application Data

(60) Provisional application No. 62/436,878, filed on Dec. 20, 2016.

(51) Int. Cl.

| | |
|---|---|
| ***B65D 5/54*** | (2006.01) |
| ***B65D 5/02*** | (2006.01) |
| ***B65D 5/42*** | (2006.01) |
| ***B65D 5/468*** | (2006.01) |
| ***B65D 5/16*** | (2006.01) |
| ***B65D 5/10*** | (2006.01) |

(52) U.S. Cl.

CPC ..... *B65D 5/542* (2013.01); *B65D 5/0227* (2013.01); *B65D 5/10* (2013.01); *B65D 5/16* (2013.01); *B65D 5/4266* (2013.01); *B65D 5/4608* (2013.01)

(58) Field of Classification Search

CPC ..... B65D 5/542; B65D 5/0227; B65D 5/10; B65D 5/16; B65D 5/4266; B65D 5/4608; B65D 2571/00574; B65D 2571/0045; B65D 71/36

See application file for complete search history.

(56) References Cited

U.S. PATENT DOCUMENTS

| | | | | |
|---|---|---|---|---|
| 3,401,865 | A * | 9/1968 | Holstrom | B65D 5/08 206/773 |
| 6,945,450 | B2 * | 9/2005 | Rusnock | B65D 71/36 229/101 |
| 2005/0061865 | A1 * | 3/2005 | Marie | B65D 5/542 229/237 |
| 2008/0203143 | A1 * | 8/2008 | Holley | B65D 5/0227 229/117.16 |
| 2010/0044420 | A1 * | 2/2010 | Brand | B65D 71/36 229/117.13 |
| 2016/0052676 | A1 * | 2/2016 | Holley, Jr. | B31B 3/26 229/117.16 |
| 2016/0159516 | A1 * | 6/2016 | Ball | B65D 71/36 229/117.13 |
| 2016/0318654 | A1 * | 11/2016 | Ayerst | B65D 5/542 |
| 2017/0158374 | A1 * | 6/2017 | Spivey, Sr. | B31B 50/81 |

* cited by examiner

*Primary Examiner* — Corey N Skurdal
(74) *Attorney, Agent, or Firm* — John D. Carpenter

(57) ABSTRACT

An improved container is provided and comprises a box having a front, back, right side, left side, top, and bottom; three handles, one each in the back, right side, and left side; a pair of primary panels; and a pair of secondary panels, the primary and secondary panels being located in the front of the box and defined by sets of perforations that facilitate the detachment of the secondary and primary panels, thereby allowing improved access to the interior of the box.

15 Claims, 6 Drawing Sheets

CONTAINER

CROSS-REFERENCE TO RELATED APPLICATION

This application claims the benefit of U.S. Provisional Application No. 62/436,878, filed Dec. 20, 2016, the contents of which are incorporated by reference herein in their entirety.

FIELD OF THE INVENTION

The invention relates to packages and containers, particularly boxes and cartons made of fiberboard, corrugated fiberboard, and similar materials.

BACKGROUND OF THE INVENTION

Consumer products, housewares, hardware, dry food, and many other goods are packaged, shipped, and sold in cardboard boxes, cartons, and similar containers. In some cases, a cardboard box has a separate lid, which is removed to allow access to the contents of the box. In other cases, the lid is an integral part of the box, which is typically formed as a flat, cardboard "blank," die-cut, folded in the shape of a box, and glued together. For some products, such as cereal, it is convenient to use a box having an integral lid formed of four flaps—front, back, left side, right side—which are lightly glued shut during the packaging of the product. For other products, such as trash bags, contractor bags, and other rolled products, the top flaps are more heavily glued shut, and the contents of the box are accessed by opening one or more flaps in the front of the box, the flap(s) being defined by perforations in the front of the box.

It can be convenient to package two or more rolls of product to a single container. For example, plastic trash bags are sometimes sold as two side-by-side rolls in a cardboard box having a flap in the front of the box. The flap is partly or wholly removed from the box by breaking the perforations. This allows at least one of the rolls to be accessed. U.S. design Pat. No. D569,719 (Ross) depicts one example of such a box.

There presently exists a need for improved containers having greater functionality, including improved portability and greater interior accessibility.

SUMMARY OF THE INVENTION

An improved container is provided and comprises a box having a front, back, right side, left side, top, and bottom; (optionally) three handles, one each in the back, right side, and left side; a pair of primary panels; and a pair of secondary panels, the primary and secondary panels being located in the front of the box and defined by sets of perforations in the front of the box, such that each of the secondary panels can be detached, wholly or in part, from the box, thereby facilitating the detachment of the primary panels, and wherein each of the primary panels can be detached, wholly or in part, from the box, thereby allowing improved access to the interior of the box. The presence of a handle in the back of the box (in addition to a handle in each side) greatly improves the portability of the container. The container is particularly adapted for carrying twin rods of rolled product, e.g., rolls of heavy duty contractor bags, trash bags, etc. Advantageously, in one embodiment, each of the primary panels contains a scored line or crease that enables the panel to be folded or curled into the interior of the box, and in abutment against a roll of, e.g., plastic contractor bags. This facilitates easier dispensing of individual bags from the roll, without removing the bag from the box.

BRIEF DESCRIPTION OF THE DRAWINGS

Various features and advantages of the invention will be understood more completely when considered in connection with the accompanying drawings (which are not necessarily drawn to scale), wherein.

Figure 1:
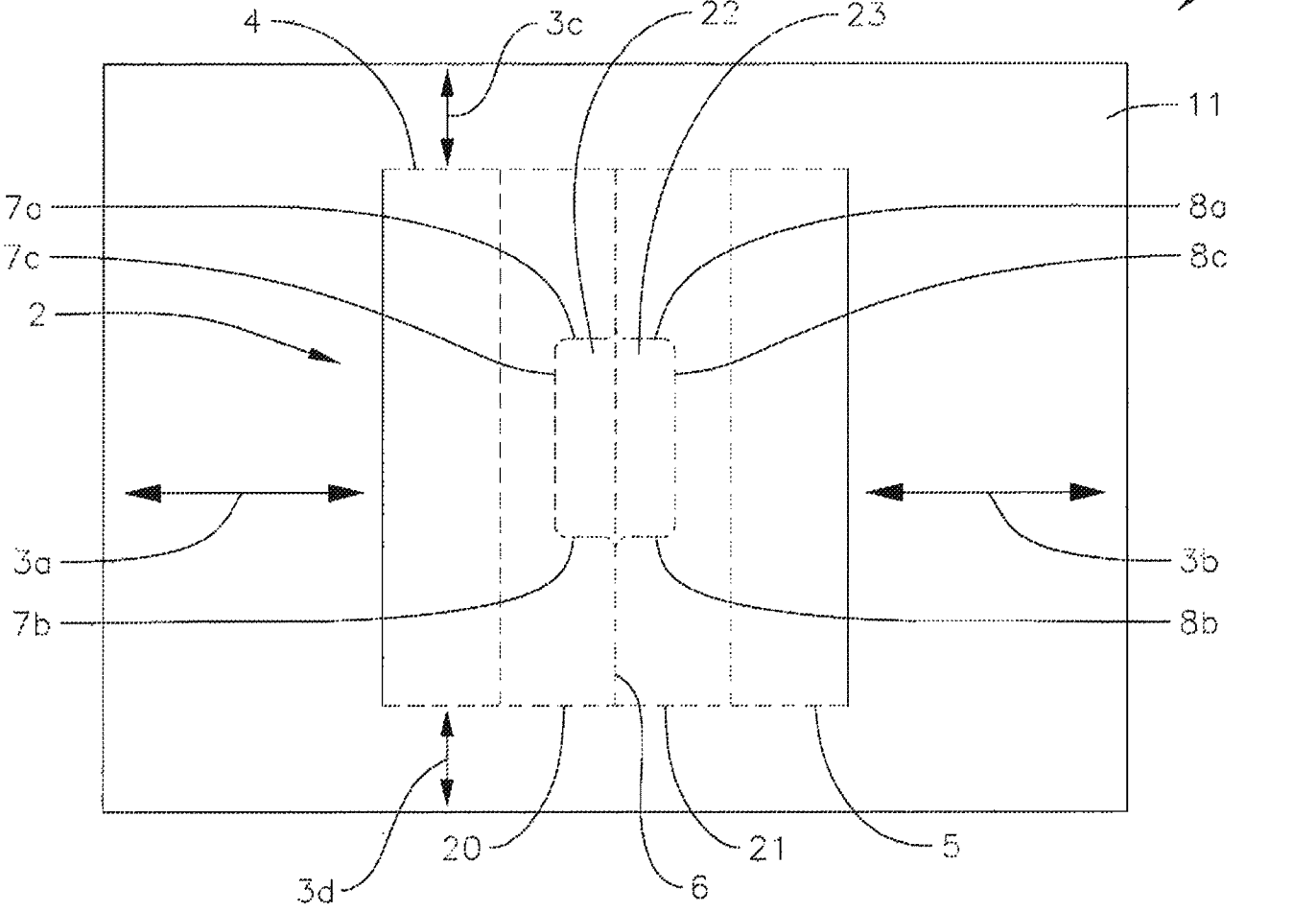
FIG. 1 is a front plan view of one embodiment of an improved container according to of the invention, with the lid closed.
Figure 2:
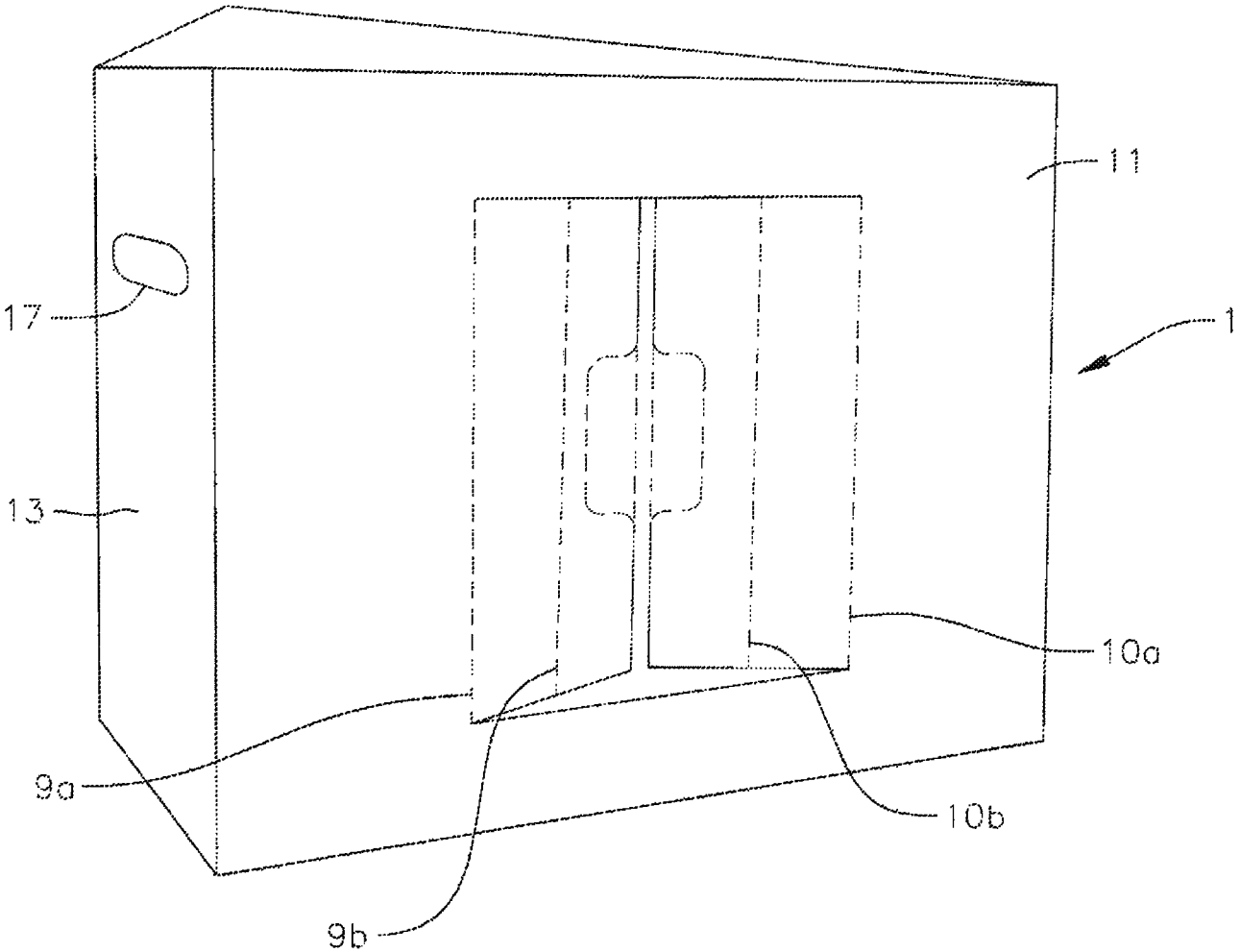
FIG. 2 is a front perspective view of the improved container shown in FIG. 1, with the top back flap shown slightly raised.
Figure 3:
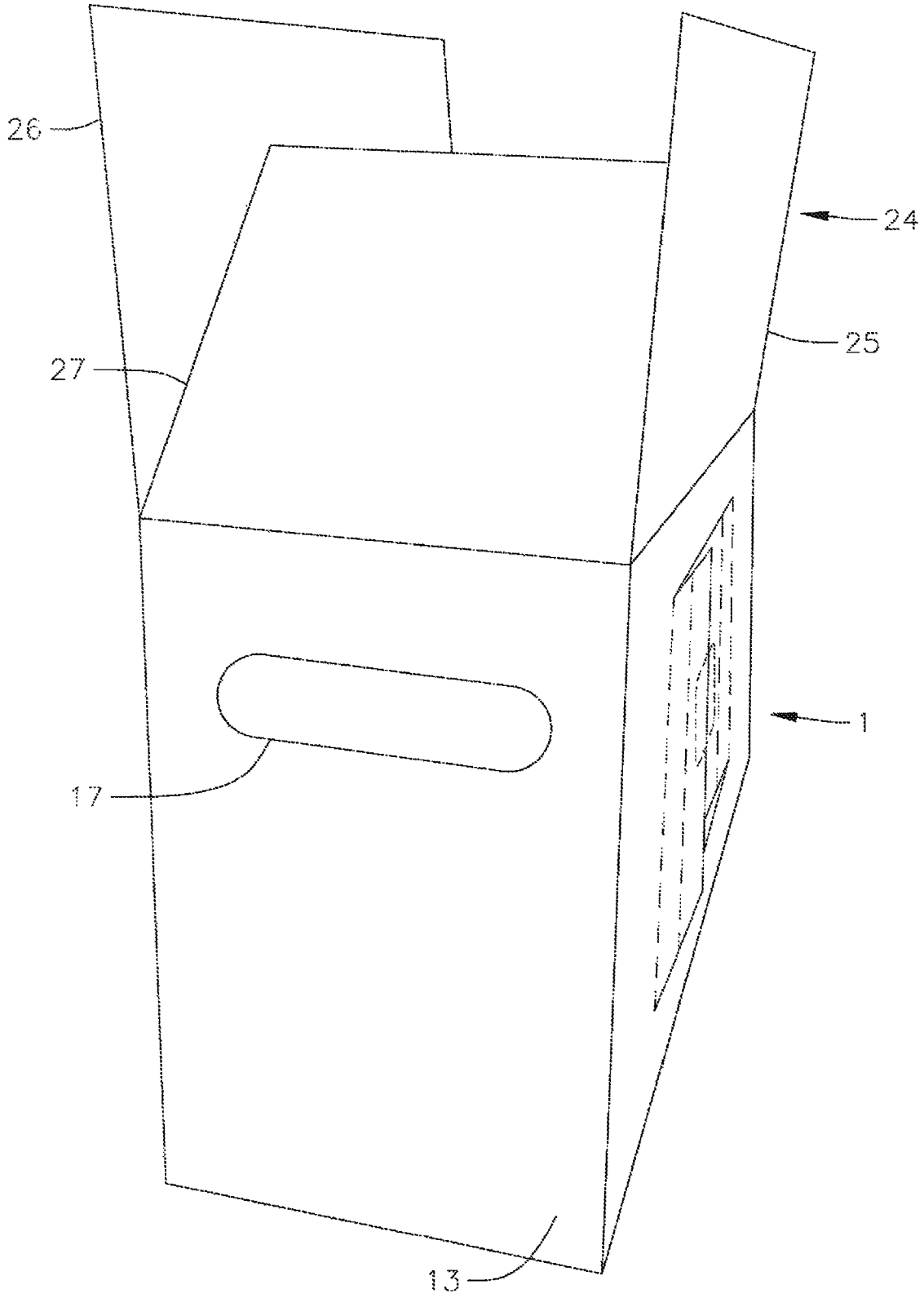
FIG. 3 is a right side perspective view of the improved container shown in FIG. 1, with the front, back, and left side flaps raised.
Figure 4:
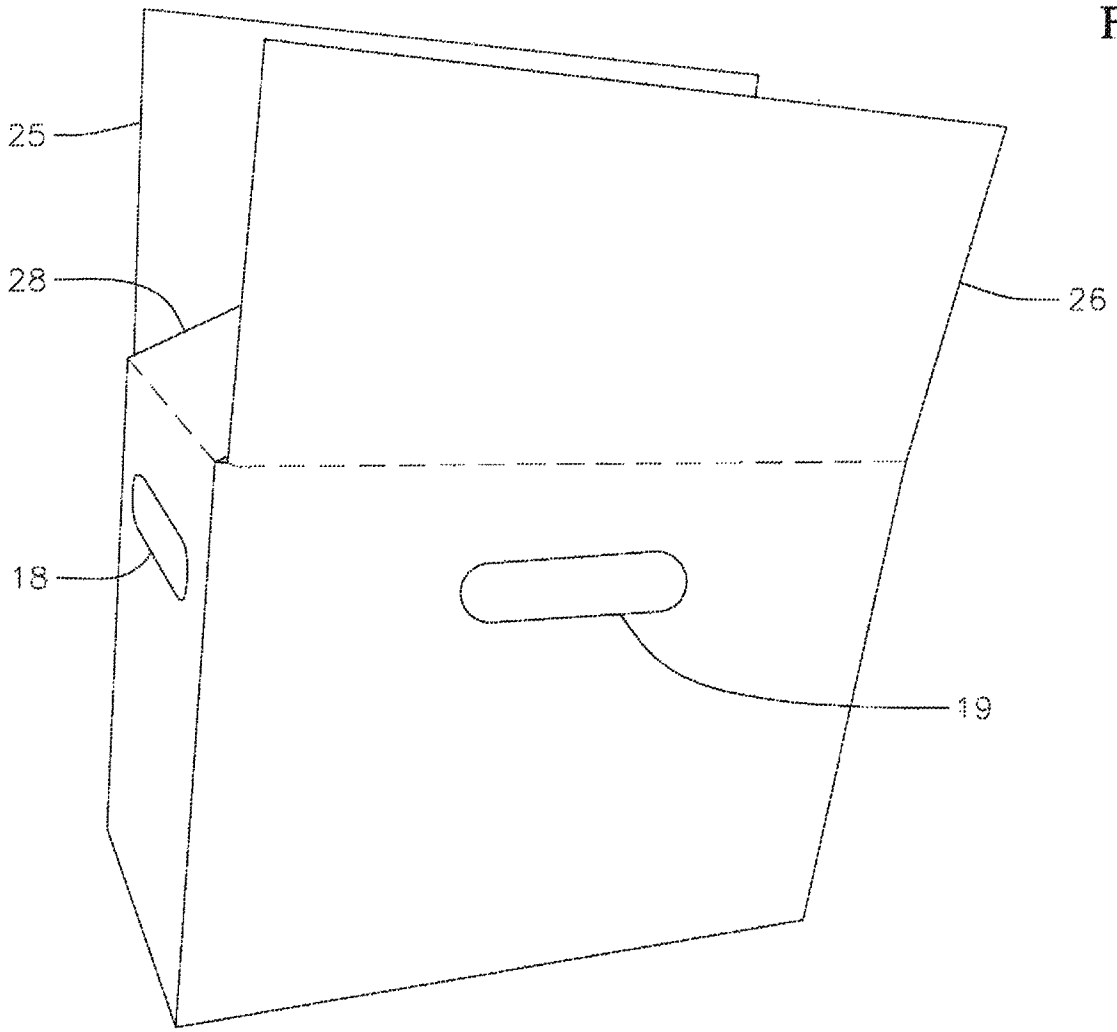
FIG. 4 is a perspective view of the back and left side of the improved container shown in FIG. 1.
Figure 5:
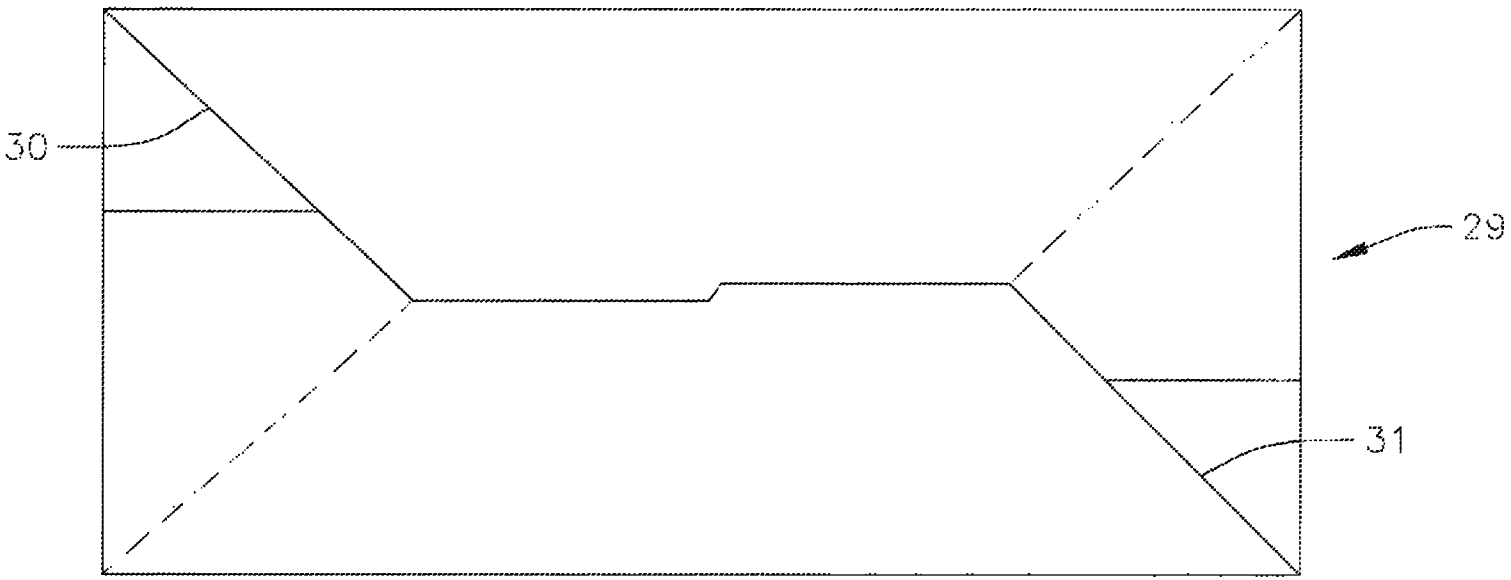
FIG. 5 is a bottom plan view of the improved container shown in FIG. 1.

DETAILED DESCRIPTION in a first aspect of the invention, an improved container is provided. In a first embodiment, depicted in FIGS. 1-6, the container is a box 1 having a substantially rectangular polyhedral shape (i.e., the box is a hollow rectangular or square prism), and is formed of "cardboard," a generic term used herein to denoted any card stock—paper board, fiber board, corrugated fiberboard, etc.—commonly associated with packages and containers. In other embodiments, the container has a different shape (e.g., nonrectangular, one or more curved sides or faces, etc.) and/or is formed of a different material suitable for use as a container, for example, a polymeric material). This type of container is particularly well suited for packaging twin rolls of product, for example, two rolls of plastic contractor bags, garbage bags, etc.

The box 1 includes a front 11, back 12, right side 13, left side 14, top 15, and bottom 16. Three handles 17, 18, and 19 are formed as slots in the box, on the right side, left side, and back of the box, respectively, and provide means for picking up and carrying the box. A pair of primary panels 20, 21 and a pair of smaller secondary panels 22, 23 are formed in the front of the box and provide means for opening the front of the box to access the contents. A lid 24 is formed of four top flaps 25, 26, 27, and 28, each top flap extending from an upper edge of, respectively, the front, back, right side, or left side of the box. Similarly, a bottom 29 is formed of four bottom flaps 30, 31, 32, and 33, each bottom flap extending from a lower edge of, respectively, the front, back, right side, or left side of the box.

The primary and secondary panels are located within a central region 2 in the front of the box, which is surrounded on four sides by a margin 3*a*-3*d* that extends to the right, left, top, and bottom edges of the front of the box. (See FIG. 1.) A top perforated line 4 extends horizontally and forms the upper boundary between the primary panels 20, 21 and the top margin 3*a*; a bottom perforated line 5 extends horizontally and forms the lower boundary between the primary panels and the bottom margin 3*b*; and a perforated center boundary line 6 extends vertically from the first to second perforated lines and forms the boundary between the left and right primary panels.

The right and left secondary panels 22, 23 are substantially rectangular in shape and are formed in the front of box by two additional sets of perforations, i.e. perforated lines: 7*a*, 7*b*, 7*c*; and 8*a*, 8*b*, 8*c*, respectively. Upper and lower perforations 7*a*, 7*b* extend substantially laterally from the center boundary line 6 to a short, vertically oriented line of perforations 7*c* (the right inner boundary) parallel with the center boundary line 6. Similarly, upper and lower perforations 8*a*, 8*b* extend substantially laterally from the center boundary line 6 to a short, vertically oriented line of perforations 8*c* (the left inner boundary) parallel with the center boundary line 6. Thus, the secondary panels are flanked by the primary panels. The transitions from the center line to the upper perforations 7*a*, 8*a*, and from the center line to the lower perforations 7*b*, 8*b* are curved. Similarly, the transitions from the upper and lower perforations 7*a*, 7*b* to the right inner boundary 7*c* are curved, and the transitions from the upper and lower perforations 8*a*, 8*b* to the left inner boundary 8*c* are curved. Consequently, when the secondary panels are detached, in whole or in part, from the primary panels, the exposed surfaces are curved, rather than angular. The curved surfaces are friendlier to the touch.

Optionally, the boundary between the outer edge of each primary panel and the adjacent right or left margin (lines 9*a* and 10*a*, respectively) is itself perforated, which enables each primary panel to be wholly detached front the from the front of the box, thereby creating a large opening to facilitate easy access to the contents of the box. In an alternate embodiment, the boundary lines 9*a*, 10*a* are lightly scored, either on the exterior of the box or the interior of the box, enabling the panels to be folded easily, rather than detached, from the front of the box.

In a preferred embodiment, one or more (additional) fold lines, which may be scored or creased, are formed in each of the primary panels, parallel to the center boundary line 6. Thus, the right primary panel includes a fold line 9*b*, which may be located midway between the center boundary line and the boundary line 9*a* between the right primary panel and the right margin 3*a*. Similarly, the left primary panel includes a fold line 10*b*, which may be located midway between the center line and the boundary line 10*a* between the left primary panel and the left margin 3*b*. These additional fold lines, which may be scored or creased, permit either or both primary panels to be folded or curled inwardly to improve access to the box contents. This is particularly advantageous when the container holds twin rolls of plastic bags, such as plastic trash bags, heavy duty contractor bags, etc. When two such rolls are seated in the box side by side, with their longitudinal axes parallel to each other (i.e., the rolls extend lengthwise from the bottom to the top of the box), folding or curling either or both primary panels into the interior of the box, in abutment with either or both rolls of bags, causes the primary panel(s) to be held against the roll(s), enabling individual bags to be dispensed more easily, without having to remove the entire roll from the box.

Figure 6:
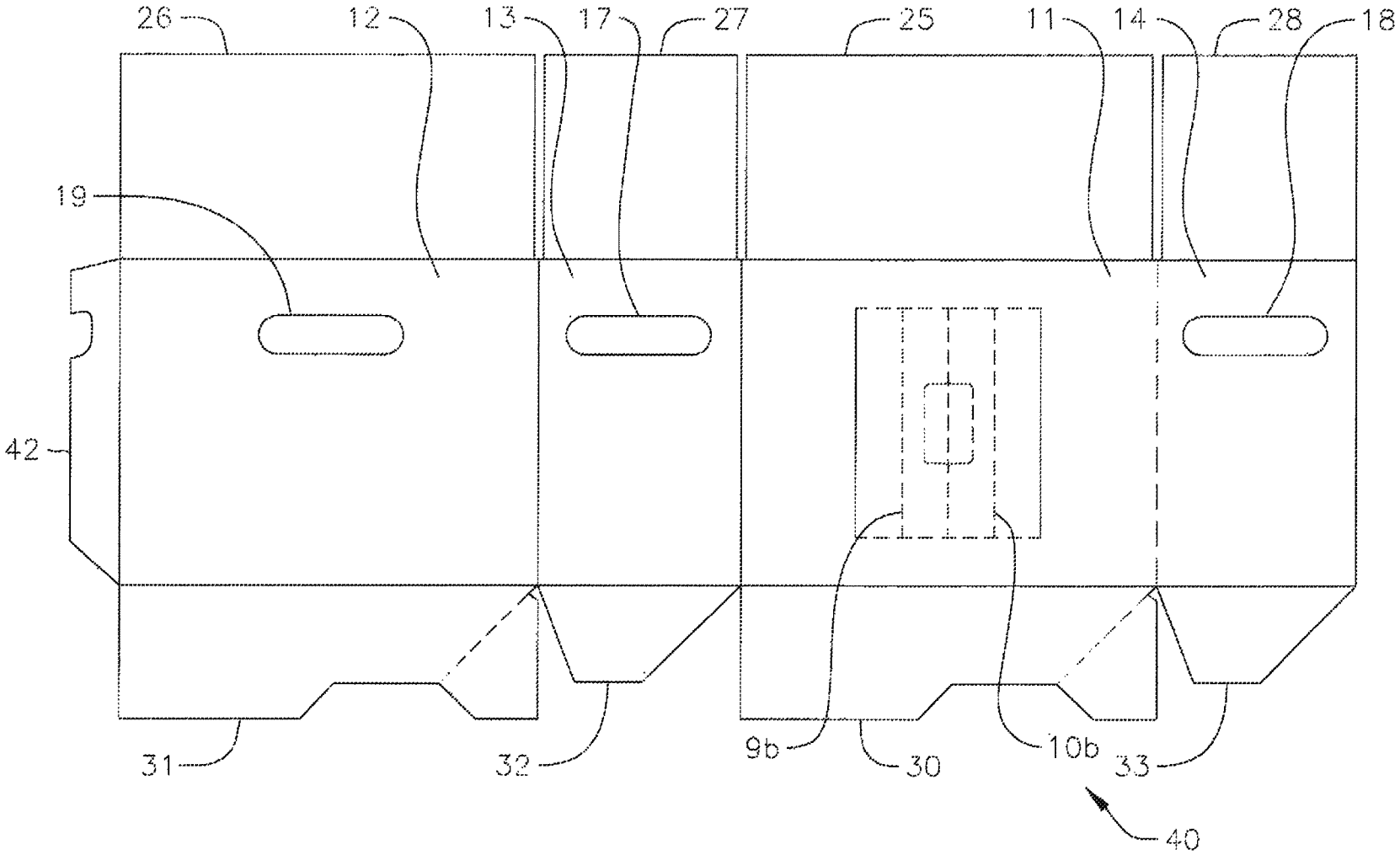
FIG. 6 is a top plan view of the exterior side of a cardboard blank used to form the improved container shown in FIGS. 1-5.

FIG. 6 depicts an outside blank 40 from which the above-described embodiment of an improved container can be formed. Thus, the blank includes the front 11, back 12, right side 13, left side 14, top flaps 25-28, and bottom flaps 30-33 which, collectively, can be folded against one another to form the box. An additional flap 42 extends from the back 12 and provides a surface to which the left side piece 14 can be glued when the box is assembled. Optional fold lines 9*b*, 10*b* are lightly scored lines on the right and left primary panels. The handles 17-19 are shown as through-cut slots; alternatively, an edge nearest the top margin may be left uncut. In that case, the handles can be pushed into the interior of the box when the box is assembled, and remain attached, thereby providing a more comfortable surface for lifting the box. The blank is readily prepared by die-cutting an appropriate "cardboard" stock, such as paperboard, fiberboard, corrugated fiberboard, etc. In the embodiment shown in FIG. 6, the blank is prepared from corrugated fiberboard, with the corrugation direction vertically aligned from the bottom to the top of the sheet.

The box is assembled by folding various flaps and pieces in a conventional way, and then gluing flap 42 to the inside of the left side piece 14. One or more products, for example, twin rolls of contractor bags, are placed inside the box, and the top flaps are folded against one another to form a lid. Optionally, to secure the lid, one or more of the top flaps 25-28 are glued to one or more adjacent flaps. The box, with its contents inside, can then be picked up and shipped. Advantageously, one can pick up the box by grabbing one or two of the three handles. Indeed, the presence of a handle on the back of the box makes it very easy for someone to carry two boxes at the same time, even when the box is loaded with heavy items. Alternatively, the box has a fourth handle located in the front of the box, in the upper margin above the primary panels. Less desirably, the box has only two, one, or no handles.

To open the box, one presses in on either or both secondary panels, which can be wholly or partly detached from the adjoining primary panel(s) and/or margin regions, e.g., along the appropriate perforated lines. Either or both primary panels can then be opened as desired, to access the contents of the box, by pressing the panel(s) and detaching the panel(s) from the surrounding matrix of material, along the appropriate perforated lines.

Additional embodiments and modifications can be made without departing from the invention, which is limited only by the appended claims and equivalents thereof.

What is claimed is:

1. An improved container, comprising:

a box having a front, back, right side, left side, top, and bottom;

a pair of adjacent primary panels located in the front of the box, each primary panel being defined by perforations in the front of the box; and a pair of adjacent secondary panels, located in the front of the box, each secondary panel being defined by perforations in the front of the box, wherein each secondary panel is flanked by a primary panel;

wherein the primary and secondary panels all share a common edge formed by perforations in the front of the box; and wherein each of the secondary panels can be detached, wholly or in part, from the box, thereby facilitating detachment of the primary panels, and wherein each of the primary panels can be detached, wholly or in part, from the box, thereby allowing improved access to the interior of the box.

2. The improved container of claim 1, wherein the common edge comprises a center line.

3. An improved container, comprising:

a box having a front, back, right side, left side, top, and bottom, wherein the front of the box includes a central region surrounded by, respectively, a top margin, bottom margin, left margin, and right margin;

a pair of adjacent primary panels located within the central region, the primary panels sharing a common center boundary line; and a pair of secondary panels located within the central region, adjacent to the primary panels;

wherein a top perforated line extends horizontally and forms an upper boundary between the primary panels and the top margin; a bottom perforated line extends horizontally and forms a lower boundary between the primary panels and the bottom margin a; and a center perforated line extends vertically from the top perforated line to the bottom perforated line and forms the center boundary line between the left and right primary panels; and wherein each secondary panel is flanked by a primary panel; and wherein each of the secondary panels can be detached, wholly or in part, from the box, thereby facilitating detachment of the primary panels, and wherein each of the primary panels can be detached, wholly or in part, from the box, thereby allowing improved access to the interior of the box.

4. The improved container of claim 3, further comprising one or more fold lines in each of the primary panels.

5. The improved container of claim 4, wherein the fold line(s) in each of the primary panels is parallel to the center line.

6. The improved container of claim 3, further comprising three handles, one each in the back, right side, and left side of the box.

7. An improved container, comprising:

a box having a front, back, right side, left side, top, and bottom;

a first handle and a second handle, wherein the first and second handles are formed, respectively, in the front and back of the box, or the right side and left side of the box;

a pair of adjacent primary panels located in the front of the box, each primary panel being defined by perforations in the front of the box; and a pair of adjacent secondary panels, located in the front of the box, each secondary panel being defined by perforations in the front of the box, wherein each secondary panel is flanked by a primary panel;

wherein each of the secondary panels can be detached, wholly or in part, from the box, thereby facilitating detachment of the primary panels, and wherein each of the primary panels can be detached, wholly or in part, from the box, thereby allowing improved access to the interior of the box.

8. An improved container, comprising:

a box having a front, back, right side, left side, top, and bottom;

a pair of adjacent primary panels located in the front of the box, each primary panel being defined by perforations in the front of the box; and a pair of adjacent secondary panels, located in the front of the box, each secondary panel being defined by perforations in the front of the box, wherein each secondary panel is flanked by a primary panel; and one or more fold lines in each of the primary panels;

wherein each of the secondary panels can be detached, wholly or in part, from the box, thereby facilitating detachment of the primary panels, and wherein each of the primary panels can be detached, wholly or in part, from the box, thereby allowing improved access to the interior of the box.

9. The improved container of claim 8, wherein the fold line(s) in each of the primary panels is parallel to a center line between the primary panels.

10. An improved container, comprising:

a box having a front, back, right side, left side, top, and bottom;

a pair of adjacent primary panels located in the front of the box, each primary panel being defined by perforations in the front of the box;

a pair of adjacent secondary panels, located in the front of the box, each secondary panel being defined by perforations in the front of the box, wherein each secondary panel is flanked by a primary panel; and three handles, one each in the back, right side, and left side of the box;

wherein each of the secondary panels can be detached, wholly or in part, from the box, thereby facilitating detachment of the primary panels, and wherein each of the primary panels can be detached, wholly or in part, from the box, thereby allowing improved access to the interior of the box.

11. An improved container, comprising:

a box having a front, back, right side, left side, top, and bottom;

a first handle, a second handle, and a third handle, wherein the first handle is formed in the back of the box or the front of the box, and the second and third handle are formed, respectively, in the right side and left side of the box;

a pair of adjacent primary panels located in the front of the box, each primary panel being defined by perforations in the front of the box; and a pair of adjacent secondary panels, located in the front of the box, each secondary panel being defined by perforations in the front of the box, wherein each secondary panel is flanked by a primary panel;

wherein each of the secondary panels can be detached, wholly or in part, from the box, thereby facilitating detachment of the primary panels, and wherein each of the primary panels can be detached, wholly or in part, from the box, thereby allowing improved access to the interior of the box.

12. An improved container, comprising:

a box having a front, back, right side, left side, top, and bottom;

a first handle formed in the back, left side, or right side of the box;

a pair of adjacent primary panels located in the front of the box, each primary panel being defined by perforations in the front of the box; and a pair of adjacent secondary panels, located in the front of the box, each secondary panel being defined by perforations in the front of the box, wherein each secondary panel is flanked by a primary panel;

wherein the primary and secondary panels all share a common edge formed by perforations in the front of the box; and wherein each of the secondary panels can be detached, wholly or in part, from the box, thereby facilitating detachment of the primary panels, and wherein each of the primary panels can be detached, wholly or in part, from the box, thereby allowing improved access to the interior of the box.

13. The improved container of claim 12, wherein the common edge comprises a center line.

14. The improved container of claim 13, further comprising one or more fold lines in each of the primary panels.

15. The improved container of claim 14, wherein the fold line(s) in each of the primary panels is parallel to the center line.

* * * * *